United States Patent [19]

Sanner

[11] 4,286,533

[45] Sep. 1, 1981

[54] CATAMARAN SAILBOAT

[76] Inventor: Sidney N. Sanner, P.O. Box 1173, Tryon, N.C. 28782

[21] Appl. No.: 69,241

[22] Filed: Aug. 23, 1979

[51] Int. Cl.[3] ..... B63B 35/00; B63H 9/00

[52] U.S. Cl. ..... 114/39; 114/61; 114/123; 114/124; 114/90

[58] Field of Search ..... 114/288, 290, 292, 39, 114/274, 281, 283, 61, 90, 121, 123, 124, 150, 56, 45; 9/1.1, 1.7

[56] References Cited

U.S. PATENT DOCUMENTS

| | | | |
|---|---|---|---|
| 1,678,023 | 7/1928 | Stites | 114/123 |
| 2,608,060 | 8/1952 | Smith | 114/150 |
| 3,417,720 | 12/1968 | Covell | 114/124 |
| 3,970,025 | 7/1976 | Sovia | 114/39 |
| 4,102,287 | 7/1978 | Ferris | 114/61 |

*Primary Examiner*—Trygve M. Blix
*Assistant Examiner*—D. W. Keen
*Attorney, Agent, or Firm*—Bell, Seltzer, Park & Gibson

[57] ABSTRACT

A catamaran sailboat is provided which has the ability to limit heeling from the wind forces, to thereby maximize the effective sail area and speed. The catamaran includes a deck assembly which may be selectively moved laterally between the hulls by the crew, and whereby the weight of the deck, mast, sail, rigging, and crew may all be moved in the windward direction to effectively counterbalance the wind forces. In one embodiment, the two hulls are each continuous along their full length, and in a second embodiment each hull comprises a pair of longitudinally aligned hull sections, with at least one hull section of each pair being rotatable about a vertical axis to effect steering of the craft.

15 Claims, 7 Drawing Figures

CATAMARAN SAILBOAT

The present invention relates to a catamaran sailboat characterized by the ability to limit heeling under various headings to thereby maximize the effective sail area and speed.

Conventional catamaran sailboats comprise twin hulls which are relatively long and narrow, and which are secured together by crossbeams. The crossbeams in turn support a rectangular plaform or deck which serves as a cockpit for the crew. The mast is fixedly mounted to the platform between the two hulls and along the longitudinal axis of the craft.

As is the case with all sailboats, a catamaran tends to heel in the leeward direction from the wind forces, when either beating against the wind or on a reach. In a strong wind, such heeling significantly reduces the effective sail area and thus speed, and it also results in the hulls contacting the water at an angle which increases their resistance to forward movement, to further limit speed. In addition, severe heeling can result in the capsizing of the boat, or taking water over the leeward side.

In an attempt to limit heeling, it is common practice for the crew of the boat to move or "hike out" over the windward side of the boat, so that the weight of the crew tends to counteract the wind forces. However, this procedure can produce only limited correction of the heeling, and further, it requires the crew to change position with each change of heading.

The French patent to Dauphin, French Pat. No. 2,337,077 represents a prior attempt to limit heeling in a catamaran, and wherein the mast and all rigging may be laterally shifted so that its weight may be positioned over one or the other of the two hulls. While this arrangement no doubt provides limited correction of the heeling, it appears that the crew would still be required to shift position with each change in heading in order to achieve an effective correction.

It is accordingly an object of the present invention to provide a catamaran sailboat having provision for effectively limiting the heeling of the craft under various headings.

It is a more particular object of the present invention to provide a catamaran sailboat having provision for readily shifting the weight of the deck, mast, sails, rigging, and crew laterally between the two hulls in order to effectively limit heeling, and thereby maximize the effective sail area and speed.

These and other objects and advantages of the present invention are achieved in the embodiments illustrated herein by the provision of a catamaran sailboat which comprises two separate interconnected hulls, and a deck assembly mounted for relative lateral movement between the two hulls. The deck assembly is adapted to support the crew of the sailboat, as well as the mast, sails, and all rigging. Means are provided for selectively moving the deck assembly laterally between the hulls and for maintaining a selected relative position therebetween, whereby the weight of the deck assembly and crew may be selectively moved laterally toward the windward hull to minimize heeling of the sailboat.

In one embodiment of the invention, each of the hulls has a longitudinal length generally corresponding to that of the deck assembly, and each of the hulls is continuous and adapted to be in buoyant contact with the water along its full length. In another embodiment, each of the hulls comprises a pair of longitudinally spaced apart hull sections, and the rearward hull section of each aligned pair may be rotated about a vertical axis to effectively steer the sailboat.

Some of the objects having been stated, other objects will appear as the description proceeds, when taken in connection with the accompanying drawings, which are somewhat schematic in form, and in which.

Figure 1:
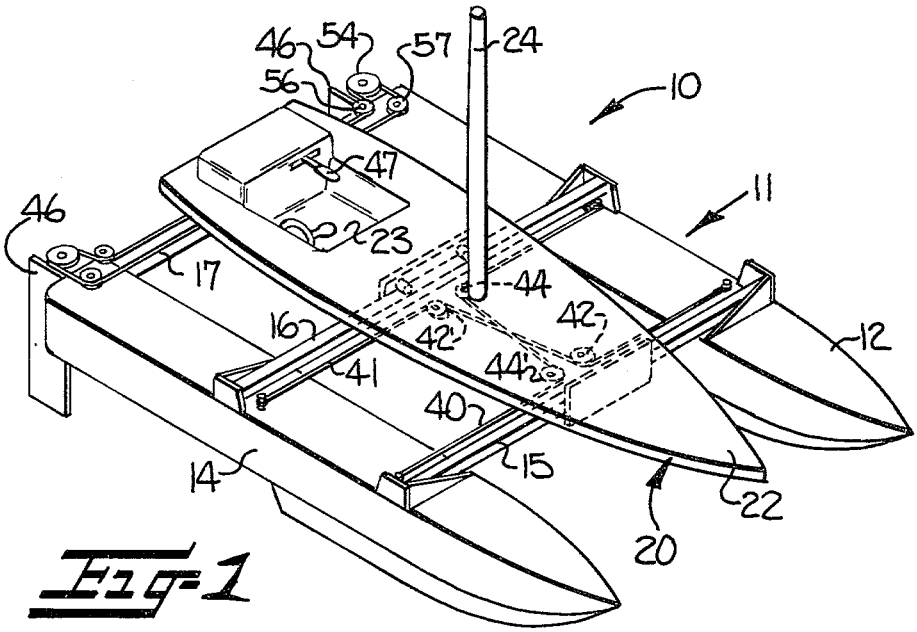
FIG. 1 is a perspective view of a catamaran sailboat embodying the features of the present invention.

Referring more specifically to the drawings, FIG. 1 illustrates a catamaran sailboat 10 which embodies the present invention, and which comprises a hull assembly 11 composed of a pair of separate elongate hulls 12 and 14. The two hulls are fabricated for example of conventional fiberglass materials, and they are fixedly interconnected to each other in a laterally spaced apart and laterally aligned relationship by a pair of longitudinally spaced apart, parallel cross beams 15, 16. Also, a third cross beam 17 extends between the hulls adjacent the stern of the boat. The beams 15, 16, and 17 are preferably fabricated from a lightweight metal, such as aluminum, and as illustrated, they are in the form of U-shaped channels. Alternatively, they may take the form of metal tubing.

Figure 2:
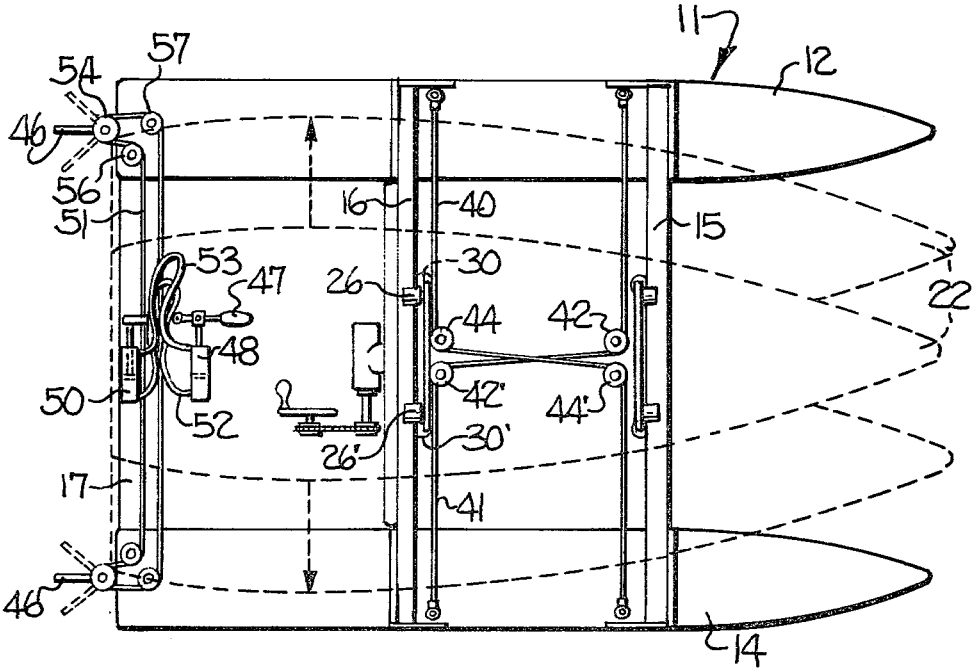
FIG. 2 is a top plan view of the sailboat illustrated in FIG. 1, and further illustrating in dashed lines the lateral movement of the deck assembly.

A deck assembly 20 is mounted to the two beams 15, 16 of the hull assembly 11 so as to permit relative lateral movement therebetween and as indicated by the dashed lines in FIG. 2. Also, the deck assembly is mounted at an elevation with respect to the hull assembly so that the deck assembly is free of buoyant contact with the water.

The deck assembly 20 comprises a generally flat deck 22 formed of fiberglass, wood or the like, and having a cockpit 23 formed therein at the stern for supporting the crew. Also, a mast 24 is fixedly mounted to the deck 22 for supporting a conventional sail, and all of the conventional standing and running rigging (not shown) for the mast and sail is secured to the deck assembly, so that upon lateral movement as hereinafter further described, the entire deck assembly 20, including the mast 24, sails, and all rigging, will be moved.

Figure 3:
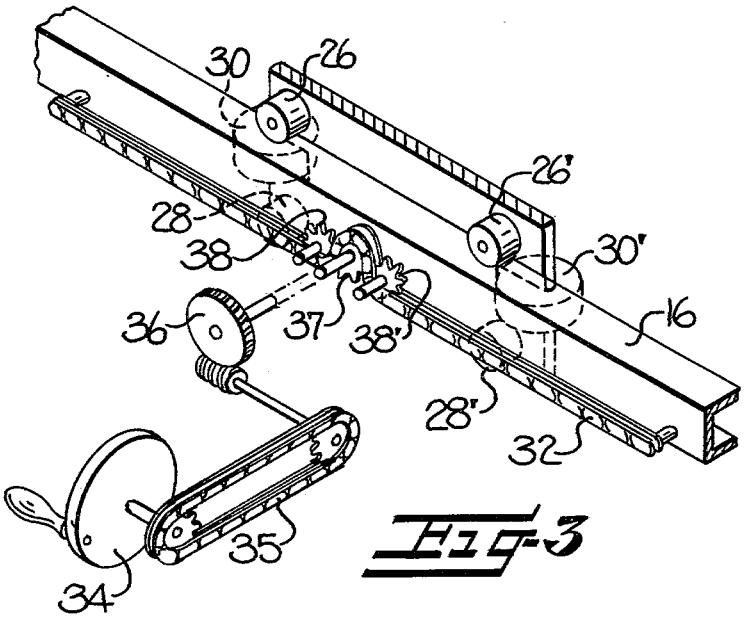
FIG. 3 is a fragmentary perspective view of the means for laterally moving the deck assembly between the hulls.
Figure 4:
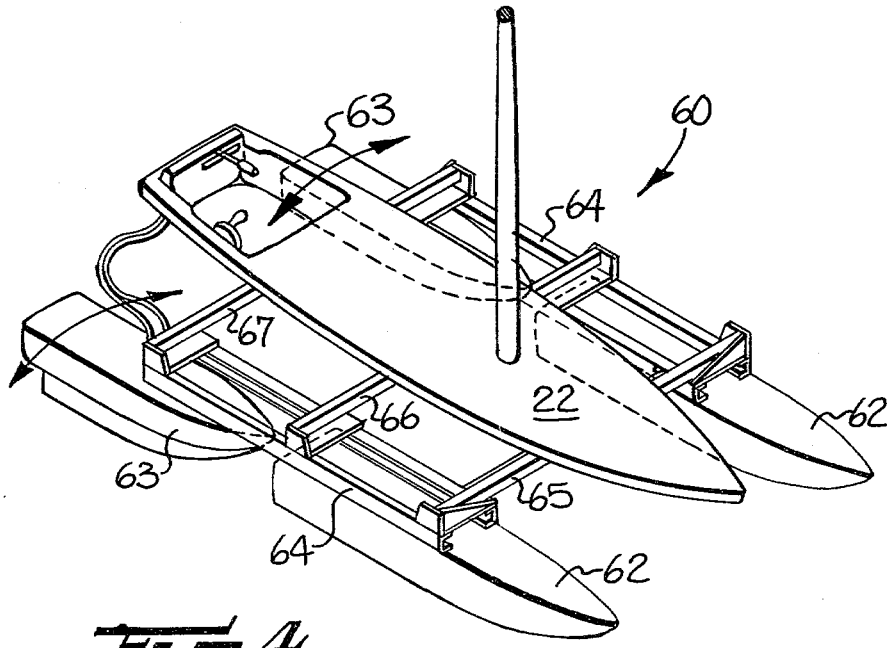
FIG. 4 is a perspective view of a second embodiment of a catamaran sailboat embodying the features of the present invention.
Figure 5:
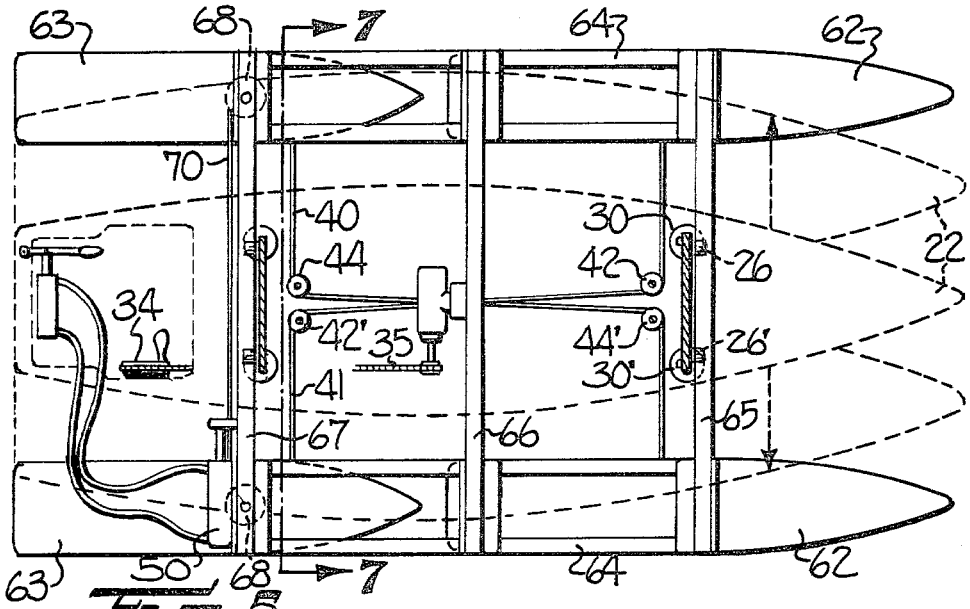
FIG. 5 is a top plan view of the sailboat shown in FIG. 4 and showing the movable deck assembly in dashed lines.
Figure 6:
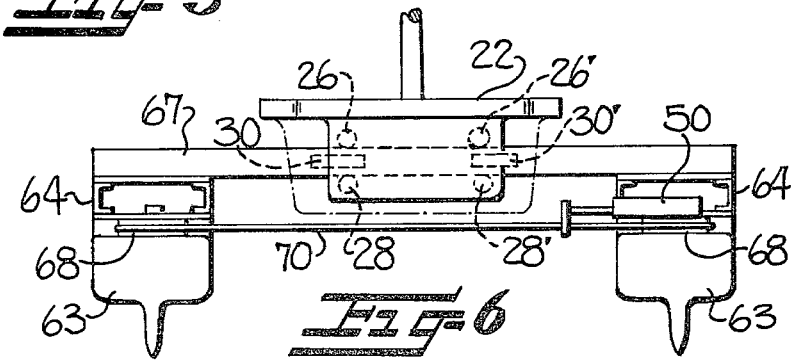
FIG. 6 is an end elevation view of the sailboat shown in FIGS. 4 and 5, and illustrating the steering mechanism for the rear hull sections.
Figure 7:
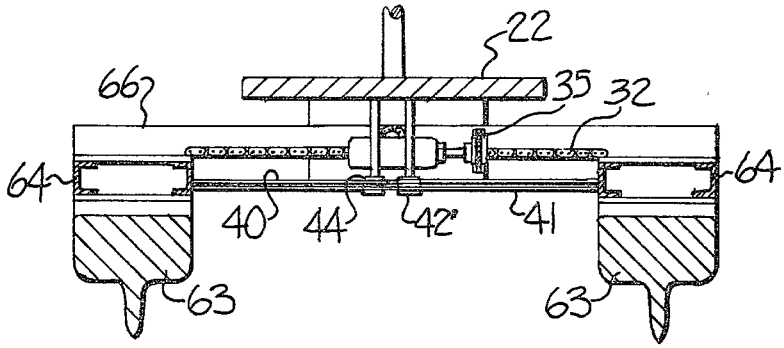
FIG. 7 is a sectional elevation view taken substantially along the line 7—7 of FIG. 5 and illustrating a portion of the means for laterally moving the deck assembly between the two hulls.

The means for mounting the deck assembly 20 to the hull assembly 11 to permit relative lateral movement comprises a pair of roller assemblies mounted to the deck assembly. One of the roller assemblies is illustrated in FIG. 3, and comprises a pair of upper rollers 26, 26' for rotation about a horizontal axis and contacting the upper surface of the beam 16. A similar pair of lower rollers 28, 28' contact the lower surface of the beam, and a third pair of rollers 30, 30' are mounted to the deck assembly for rotation about a vertical axis and contact a side face of the beam. As seen in FIG. 2, the pairs of vertical rollers 30, 30' of the two roller assemblies respectively contact opposing sides of the two beams 15, 16, to preclude longitudinal movement between the deck assembly and hull assembly.

Means are also provided for selectively moving the deck assembly 20 laterally between the hulls 12, 14, and for maintaining a selected relative position therebetween. This moving means is best illustrated in FIG. 3, and comprises an elongate power transmission means or chain 32 which is fixed to and extends laterally along the beam 16. Manually operable sprocket means is fixed to the deck assembly, and comprises a hand wheel 34 mounted in the cockpit 23, a chain and sprocket assembly 35, a self-locking worm gear reducer 36, and a sprocket 37 which operatively engages the chain 32. A pair of idler sprockets 38, 38' are mounted to the beam 16 immediately adjacent the sprocket 37 to maintain proper engagement between the sprocket 37 and chain 32. As will be apparent from the above description, rotation of the hand wheel 34 by a crew member results in the deck assembly moving laterally along the beams 15, 16. Also, the worm gear reducer 36 acts to maintain a selected relative position by precluding rotational movement from the sprocket 37 toward the hand wheel 34. Thus lateral movement of the deck assembly can be effected only by the rotation of the hand wheel, and a crew member may rotate the hand wheel in either direction to move the deck assembly in the intended direction, and he may release his hold on the hand wheel and the deck assembly will maintain its relative position with respect to the hull assembly.

As best seen in FIG. 2, the means mounting the deck assembly 20 to the hull assembly 11 also includes a pair of cables 40, 41 which serve to limit and control canting or twisting movement between the deck assembly and hull assembly. The ends of each cable are fixed to the opposite hulls 12, 14 at longitudinally spaced points, and as seen in FIG. 2, each end of each cable is laterally aligned with an end of the other cable. Two pairs of pulleys 42, 42' and 44, 44' are mounted to the underside of the deck portion, with one pair engaging each cable and so that each cable includes a medial portion which extends in a direction which has a substantial longitudinal component. Thus the two cables 40, 41 form a rigidifying somewhat X-shaped brace between the deck assembly and hull assembly, while permitting relative lateral movement therebetween. The pulleys are preferably mounted as close to the longitudinal centerline of the deck as possible so as to avoid contact between the pulleys and hulls during maximum lateral movement of the deck, and the adjacent pulleys may if desired be mounted for rotation about a common axis.

In the embodiment of FIGS. 1–3, each hull 12, 14 is continuous and adapted to be in buoyant contact with the water along its full length. Also, each of the hulls 12, 14 has a longitudinal length generally corresponding to that of the deck 22. To effect steering, a rudder 46 is pivotally mounted at the stern of each hull, and a cooperating tiller 47 is pivotally mounted in the cockpit for simultaneously controlling the position of each rudder. More particularly, the tiller 47 is operatively connected to each rudder 46 by a hydraulic servo mechanism, which comprises a first hydraulic cylinder 48 connected to the tiller 47 and mounted to the deck 22, a second hydraulic cylinder 50 mounted to the beam 17 and connected to an endless cable 51, and a pair of flexible hydraulic lines 52, 53 for interconnecting the two cylinders. A pulley 54 is fixed to each rudder 46, and the cable 51 is guided into contact with each pulley 54 by the guide pulleys 56, 57 which are fixed to the hulls. As will be apparent, lateral movement of the tiller 47 causes the cable 51 to move, which in turn acts to rotate the two rudders 46 in a common direction.

A second embodiment of a sailboat embodying the present invention is indicated generally at 60 in FIGS. 4–7. In describing the sailboat 60, like numerals are utilized to designate elements which are common with the sailboat 10.

In the sailboat 60, each of the separate hulls on each side of the craft comprises a pair of hull sections 62, 63, and a support 64 interconnects the two hull sections in a longitudinally aligned and spaced apart relationship. Three cross beams 65, 66, 67 interconnect the supports 64 of the two hulls and the roller assemblies are positioned on the deck 22 to engage the outermost beams 65, 67, note FIG. 5. Means including a chain 32 and hand wheel 34 are also provided for laterally moving the deck as described above with respect to the sailboat 10, and cables 40, 41 as described above are provided for limiting canting between the deck assembly and hull assembly.

As an alternative to rudder steering, the sailboat 60 has provision for effecting steering by rotation of the rear hull section 63 of each hull about a vertical axis. More particularly, each rear hull section 63 is mounted to its associated support 64 for rotation about a vertical axis. The steering mechanism includes a pulley 68 fixed to each rear hull section 63 for rotation about the vertical axis, and an endless cable 70 interconnecting the two pulleys 68, note FIG. 6. The second hydraulic cylinder 50 of the above-described hydraulic servo mechanism is fixed to the beam 67, and is operatively connected to the cable 70, so that movement of the tiller 47 acts to move the cable 70 and rotate the two rear hull sections 63 about their respective vertical axes of rotation.

The use of two hull sections 62, 63 is seen to further provide the sailboat 60 with improved longitudinal stability. In this regard, planing type hulls are generally preferred for use with the present invention as opposed to displacement type hulls, since planing hulls have less draft, and provide less resistance to forward movement through the water. However, planing hulls tend to rise in the water as the forward speed increases, which reduces the longitudinal length of the hull which is in supporting contact with the water. This in turn reduces the longitudinal stability of the boat, and can result in "porpoising" or nosing over. The use of two hull sections 62, 63 tends to alleviate this tendency, since while each planing hull section will tend to lift in the water with speed, the longitudinal distance between the forward and aft points of support would remain substantially constant at all speeds, thereby providing improved longitudinal stability.

In the drawings and specification, there has been set forth a preferred embodiment of the invention, and although specific terms are employed, they are used in a generic and descriptive sense only and not for purposes of limitation.

That which is claimed is:

1. A catamaran sailboat characterized by the ability to limit heeling under various headings to thereby maximize the effective sail area and speed, and comprising a hull assembly comprising a pair of separate hulls, and means fixedly interconnecting said hulls in a laterally spaced apart and laterally aligned relationship, and with said hulls being adapted to buoyantly support the full weight of the sailboat, a deck assembly comprising a deck adapted to support the crew of the sailboat, and a mast fixed to said deck for supporting a sail, means mounting said deck assembly to said hull assembly to permit relative lateral movement therebetween, and with the deck assembly being at an elevation so as to be free of buoyant contact with the water, and means for effecting relative lateral movement between said deck assembly and said hulls, whereby the weight of the deck assembly and crew may be selectively moved laterally toward the windward hull to minimize heeling of the sailboat.

2. The sailboat as defined in claim 1 wherein said means for effecting relative movement between said deck assembly and said hulls comprises an elongate, laterally directed power transmission means fixedly mounted to said hull assembly, and manually operable sprocket means mounted to said deck assembly and operatively engaging said power transmission means, whereby operation of said sprocket means by the crew causes said deck assembly to move laterally with respect to the two hulls.

3. The sailboat as defined in claim 2 wherein said sprocket means includes self-locking means for maintaining the deck assembly and hull assembly in a selected relative position.

4. The sailboat as defined in claim 2 wherein said sprocket means includes hand rotation means positioned for manual rotation by the crew, a sprocket operatively engaging said power transmission means, and self-locking gear reduction means operatively interconnecting said hand rotation means and sprocket, whereby lateral movement of said deck assembly can be effected only by the rotation of said hand rotation means.

5. The sailboat as defined in claim 4 wherein said power transmission means comprises a chain.

6. The sailboat as defined in claim 1 wherein said means fixedly interconnecting said hulls comprises a pair of longitudinally spaced apart, laterally directed beams, and said mounting means comprises roller means mounted to said deck assembly and operatively contacting said beams to permit rolling movement therebetween.

7. The sailboat as defined in claim 1 wherein said mounting means further comprises cable means for limiting canting between said deck assembly and said hull assembly, and comprising first and second cables fixedly interconnected between said hulls, with the ends of each cable being fixed to the opposite hulls at longitudinally spaced points, and pulley means mounted on said deck assembly and operatively engaging each cable so that each cable includes a medial portion which extends in a direction having a substantial longitudinal component.

8. The sailboat as defined in claim 7 wherein each end of each cable is laterally aligned with an end of the other cable.

9. The sailboat as defined in claim 1 wherein each of said separate hulls has a longitudinal length generally corresponding to that of said deck.

10. The sailboat as defined in claim 9 wherein each of said separate hulls is continuous and adapted to be in buoyant contact with the water along its full length.

11. The sailboat as defined in claim 10 further comprising means for steering the sailboat and comprising a rudder mounted to each hull, and tiller means for simultaneously moving the two rudders.

12. The sailboat as defined in claim 11 wherein said tiller means comprises a tiller pivotally mounted to said deck, and hydraulic servo mechanism means operatively interconnecting said tiller and rudders.

13. The sailboat as defined in claim 9 wherein each of said separate hulls comprises a pair of hull sections, and an interconnecting support joining said hull sections in a longitudinally aligned and spaced apart relationship.

14. The sailboat as defined in claim 13 wherein at least one of each pair of hull sections is rotatably joined to its associated interconnecting support to permit rotation of such hull section about a vertical axis, and wherein said sailboat further comprises means for steering the sailboat and including tiller means for selectively rotating each rotatable hull section about its vertical axis.

15. The sailboat as defined in any one of claims 1–5 and 7–14, wherein said means fixedly interconnecting said hulls comprises a plurality of longitudinally spaced apart, laterally directed beams, and wherein said deck is disposed essentially above said beams.

* * * * *